US007472838B2

(12) United States Patent
Omura et al.

(10) Patent No.: US 7,472,838 B2
(45) Date of Patent: Jan. 6, 2009

(54) FLUID INJECTION VALVE

(75) Inventors: Hidekazu Omura, Hekinan (JP); Yoshinori Yamashita, Kariya (JP); Yukio Tomiita, Anjo (JP); Yukio Sawada, Anjo (JP)

(73) Assignee: Denso Corporation (JP)

( * ) Notice: Subject to any disclaimer, the term of this patent is extended or adjusted under 35 U.S.C. 154(b) by 160 days.

(21) Appl. No.: 11/258,288

(22) Filed: Oct. 26, 2005

(65) Prior Publication Data

US 2006/0086830 A1 Apr. 27, 2006

(30) Foreign Application Priority Data

Oct. 26, 2004 (JP) ..... 2004-310931
Sep. 22, 2005 (JP) ..... 2005-275268

(51) Int. Cl.
*F02M 47/02* (2006.01)
*F02M 61/00* (2006.01)

(52) U.S. Cl. ..... 239/88; 239/533.12; 239/533.14; 239/596

(58) Field of Classification Search ..... 239/88–93, 239/533.2, 533.12, 533.14, 596, 585.1, 585.3, 239/585.4, 585.5; 251/129.15, 129.21, 127
See application file for complete search history.

(56) References Cited

U.S. PATENT DOCUMENTS 5,263,648 A * 11/1993 Vogt et al. ..... 239/585.4
5,449,114 A * 9/1995 Wells et al. ..... 239/5
5,931,391 A * 8/1999 Tani et al. ..... 239/585.4
6,170,763 B1 1/2001 Fuchs et al.
6,173,914 B1 1/2001 Hopf et al.
6,230,992 B1 5/2001 Arndt et al.
6,405,946 B1 6/2002 Harata et al.
6,616,072 B2 9/2003 Harata et al.
6,669,116 B2 * 12/2003 Iwase ..... 239/533.12
6,929,196 B2 * 8/2005 Togashi et al. ..... 239/533.14
2004/0124279 A1 7/2004 Harata et al.

* cited by examiner

*Primary Examiner*—Davis D Hwu
(74) *Attorney, Agent, or Firm*—Nixon & Vanderhye PC

(57) ABSTRACT

A fluid injection valve has: a valve body that is provided with an opening portion at one axial end thereof and is for starting and stopping a supply of a fluid out of the opening portion; and an injection port plate having a plurality of injection ports that penetrate therethrough, the injection port plate being fixed on the one axial end of the valve body to form a fluid chamber between itself and the valve body to accumulate the fluid therein and to which at least a part of the injection ports opens. A circumferential surface of the fluid chamber recedes toward the injection ports so as to decrease a cross-sectional area of the fluid chamber that is taken along a radial direction of the injection port plate and to reserve a predetermined length of distance between itself and the injection ports.

15 Claims, 18 Drawing Sheets

FLUID INJECTION VALVE

CROSS REFERENCE TO RELATED APPLICATION

This application is based upon and claims the benefit of priority of Japanese Patent Applications No. 2004-310931 filed on Oct. 26, 2004 and No. 2005-275268 filed on Sep. 22, 2005, the contents of which are incorporated herein by reference.

FIELD OF THE INVENTION

The present invention relates to a fluid injection valve suitable for injecting fuel into cylinders of an internal combustion engine (hereinafter referred to just as "engine").

BACKGROUND OF THE INVENTION

In fuel injection valves for engines, it is important to atomize the fuel injection spray sufficiently from viewpoints of toxic substance reduction in emission gas, fuel consumption performance improvement and so on. U.S. Pat. Nos. 6,405,946-B1, 6,616,072-B2, US-2004-0124279-A1 and their counterpart JP-2001-46919-A disclose fluid injection nozzles for promoting an atomization of the fuel injection spray.

In the fluid injection nozzles disclosed in the above publications, a flat disc-shaped fuel chamber is formed between a valve seat and injection ports. By the fuel chamber provided between the valve seat and the injection ports, fuel, which has flown on an inner circumferential surface of the valve body, passes through an opening portion of the valve body, then forms a spread flow in the fuel chamber. Thus, at the outflow side of the injection ports, it is possible to decrease collisions among fuel spray columns that are injected out of the injection ports.

However, by forming the fuel chamber between the valve seat and the injection ports, a dead volume in the fluid injection nozzle increases. When the dead volume is large, a relatively large amount of fuel is left in the fuel chamber without being injected out of the injection ports. For example, in a case that a fuel injection valve is installed in an intake pipe of an engine, the fuel left in the fuel chamber is sucked by intake air that flows through the intake pipe at a large speed. Thus, a fuel ratio in the intake air increases, and it becomes difficult to control the fuel injection amount with high accuracy.

SUMMARY OF THE INVENTION

The present invention, in view of the above-described issue, has an object to provide a fluid injection valve that can promote an atomization of fluid injection spray and decrease a volume of its fluid chamber.

The fluid injection valve has: a valve body that is provided with an opening portion at one axial end thereof and is for starting and stopping a supply of a fluid out of the opening portion; and an injection port plate having a plurality of injection ports that penetrate therethrough, the injection port plate being fixed on the one axial end of the valve body to form a fluid chamber between itself and the valve body to accumulate the fluid therein and to which at least a part of the injection ports opens. A circumferential surface of the fluid chamber recedes toward the injection ports so as to decrease a cross-sectional area of the fluid chamber that is taken along a radial direction of the injection port plate and to reserve a predetermined length of distance between itself and the injection ports.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

First Embodiment

Figure 2:
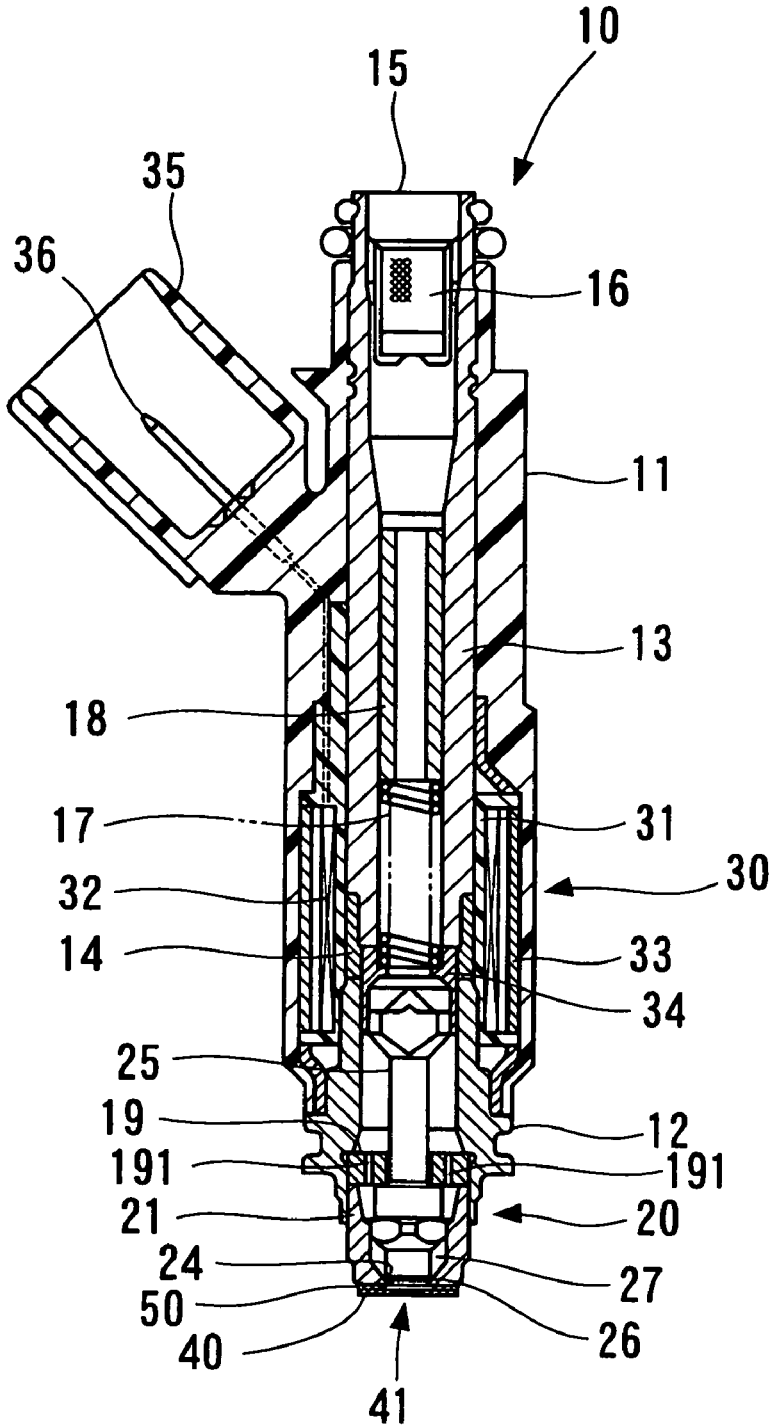
FIG. 2 is a cross-sectional view showing the fluid injection valve according to the first embodiment.

FIG. 2 depicts a fluid injection valve (hereinafter referred to as injector) 10 according to a first embodiment of the present invention. The injector 10 is for injecting fuel at an intake port of a gasoline engine, that is, for a port fuel injection engine. The injector 10 shown in FIG. 2 is merely an example, and may be modified to have other driving mechanism therein, to be applied to other types of engine, and so on.

The injector 10 has a casing 11, a magnetic pipe 12, a fixed core 13 and a driving portion 30. The casing 11 is a resinous mold that covers the magnetic pipe 12, the fixed core 13, the driving portion 30 and so on. At one end portion of the magnetic pipe 12 is installed a nozzle 20. Between the magnetic pipe 12 and the fixed core 13 is installed a nonmagnetic pipe 14 against a magnetic short circuit. The fixed core 13 and the nonmagnetic pipe 14, and the nonmagnetic pipe 14 and the magnetic pipe 12 are respectively connected with each other by laser welding and the like. One axial end portion of the fixed core 13 is formed a fuel inflow port 15. Fuel is supplied from a fuel pump (not shown) to the fuel inflow port 15 of the injector 10. The fuel supplied to the fuel inflow port 15 flows via a fuel filter 16 into an inner space of the fixed core 13. The fuel filter 16 is for removing foreign matters contained in the fuel.

Figure 3:
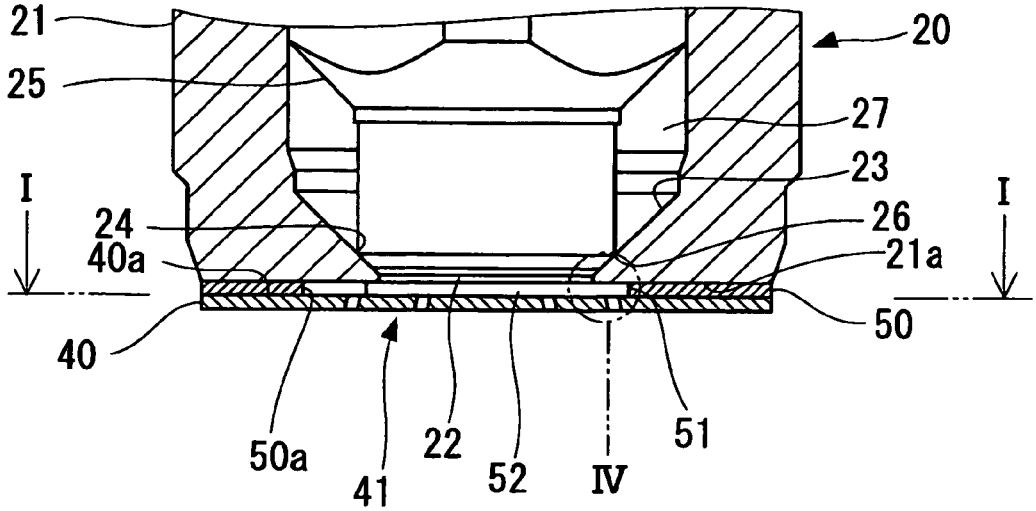
FIG. 3 is an enlarged cross-sectional view showing the fluid injection nozzle in the proximity of the injection port plate according to the first embodiment.

The valve body 21 is installed on one end of the magnetic pipe 12 opposite from the fixed core 13. The valve body 21 is connected with the magnetic pipe 12 by laser welding and the like. As shown in FIG. 3, the valve body 21 is cylinder-shaped and has an opening portion 22 at its axial end opposite from the fuel inflow port 15. The valve body 21 has a cone-shaped inner circumferential surface 23, which is tapered so that its inner diameter gradually decreases as coming closer to the opening portion 22 at its leading end. The valve body 21 further has a valve seat 24 on the cone-shaped inner circumferential surface 23. On the leading end of the valve body 21, which is at the side of the opening portion 22, is installed an injection port plate 40 to cover the leading end portion of the valve body 21. The Injection port plate 40 has injection ports 41 that penetrate the injection port plate 40 in its thickness direction to communicate its one surface at the side of the valve body 21 with its another surface.

The needle (valve member) 25 is installed on the inner circumferential side of the magnetic pipe 12 and the valve body 21 to be slidable in its axial direction. The needle 25 is aligned approximately coaxial to the valve body 21. One axial end of the needle 25, which is opposite from the fuel inflow port 15, is provided with a seal portion 26. The seal portion 26 is for coming in contact with a valve seat 24 formed in the valve body 21. The needle 25 and the valve body 21 form a fuel passage 27 therebetween.

As shown in FIG. 2, the injector 10 is provided with a driving portion 30 for driving the needle 25. The driving portion 30 includes a spool 31, a coil 32, a fixed core 13, a magnetic pipe 12, a plate housing 33 and a movable core 34. The spool 31 is installed on an outer circumferential side of the magnetic pipe 12, the fixed core 13 and the nonmagnetic pipe 14. The spool 31 is cylinder-shaped and made of resin. On outer circumference of the spool 31 is wound the coil 32. The coil 32 is connected to a terminal portion 36 of a connector 35. The fixed core 35 is installed on the inner circumferential side of the coil 32. The fixed core 13 is cylinder-shaped and made of magnetic material such as steel. The plate housing 33 is made of magnetic material and covers an outer circumference of the coil 32. The plate housing 33 is magnetically connected with the fixed core 13 and the magnetic pipe 12. The outer circumference of the spool 31 and the coil 32 is covered by the casing 11, which is integrally formed with the connector 35.

The movable core 34 is installed inside the fixed core 13 to be slidable in its axial direction. The movable core 34 is cylinder-shaped and made of magnetic material such as steel. One end of the movable core 34 opposite from the fixed core 13 is integrally connected to the needle 25. Another end of the movable core 34 at the side of the fixed core 13 is in contact with a spring (elastic member) 17. The spring 17 is in contact with the movable core 34 at one end and with an adjusting pipe 18 at another end. The adjusting pipe 18 is press-fitted in the fixed core 13.

The spring 17 has a restitutive force to extend in the axial direction. Thus, the spring 17 pushes the movable core 34 and the needle 25 toward the valve body 21. The load that the spring 17 applies to the movable core 34 and the needle 25 can be modified by adjusting a press-fitting amount of the adjusting pipe 18 press-fitted into the fixed core 17. When the coil 32 is not energized, the spring 17 pushes the movable core 34 and the needle 25 toward the valve seat 24, and the seal portion 26 is seated on the valve seat 24. In the present embodiment, a coil spring is shown as an example of the spring 17. Alternatively, the spring 17 may be realized by other elastic members such as a leaf spring, an air damper, a fluid damper and so on.

The injector 10 in the proximity to the injection port plate 40 is described in detail in the following.

Figure 1:
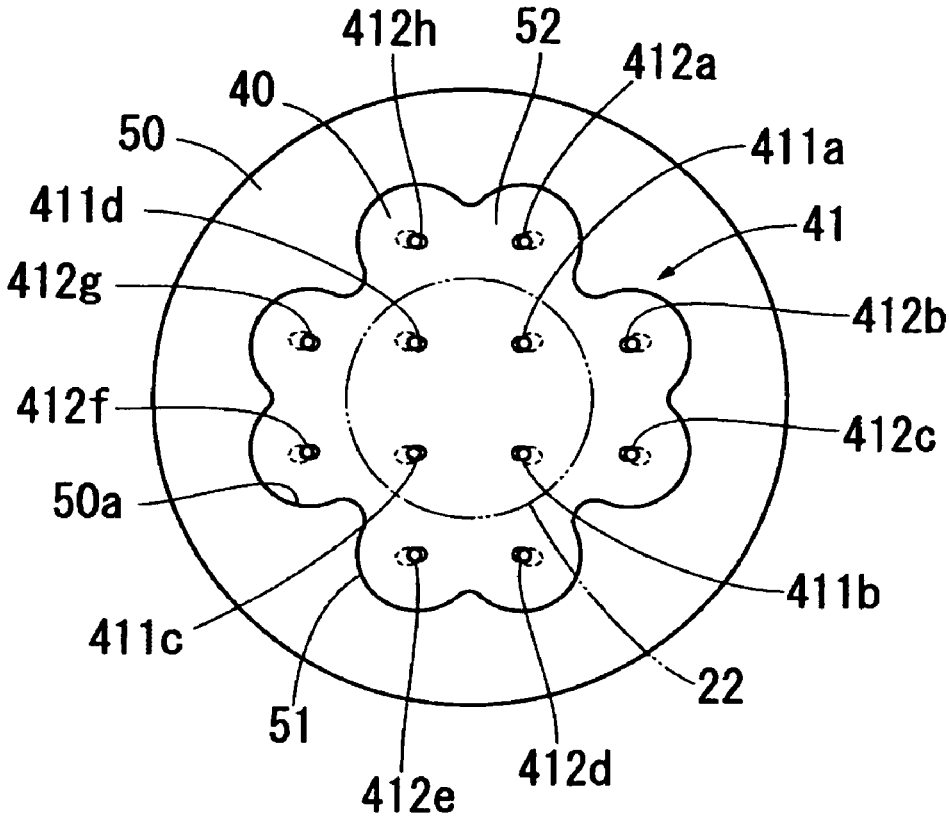
FIG. 1 is a cross-sectional view showing an injection port plate of a fluid injection valve according to a first embodiment of the present invention, which is taken along a line I-I in FIG. 3.

The injection port plate 40 is disposed on the leading end of the valve body 21. As shown in FIG. 3, a spacer 50 is disposed between the valve body 21 and the spacer 50. The spacer 50 is disc-shaped and interposed between the valve body 21 and the injection port plate 40. As shown in FIGS. 1 and 3, the spacer 50 has a fuel chamber opening 51 that open to the combustion chamber of the engine. An inner circumferential surface 50*a* of the spacer 50 surrounds the fuel chamber opening 51. Thus, an end surface 21*a* of the valve body 21 at the side of the injection plate 40, an end surface 40*a* of the injection port plate 40 at the side of the valve body 21 and the inner circumferential surface 50*a* of the spacer 50 define a space for a fuel chamber 52. The fuel chamber 52 is provided between the opening portion 22 of the valve body 21 and the injection ports 41 of the injection port plate 40. At least a part of the fuel chamber 52 overlaps with the opening portion 22 of the valve body 21. Thus, the fuel that has passed through the opening portion 22 of the valve body 21 flows via the fuel chamber 52 into the injection ports 41.

As described above, the inner circumferential surface 50*a* of the spacer 50 forms a perimeter of the fuel chamber 52. Thus, a shape of the fuel chamber opening 51 and the inner circumferential face 50*a* of the spacer 50 determine a cross-sectional shape of the fuel chamber 51. In the first embodiment, the injection ports 41 formed on the injection port plate 40 are aligned on two coaxially disposed fictive circle lines as shown in FIG. 1. The injection ports 41 include four inner injection ports 411*a*-411*d*, which are aligned on the inner fictive circle line, and eight outer injection ports 412*a*-412*h*, which are aligned on the outer fictive circle line. The four inner injection ports 411*a*-411*d* and the eight outer injection ports 412*a*-412*h* are respectively disposed at a regular intervals on the fictive circle lines. One ends of the injection ports 41 open to the fuel chamber 52. Alternatively, the injection ports 41 may be aligned at irregular intervals in a circumferential direction of the injection port plate 40.

Figure 4:
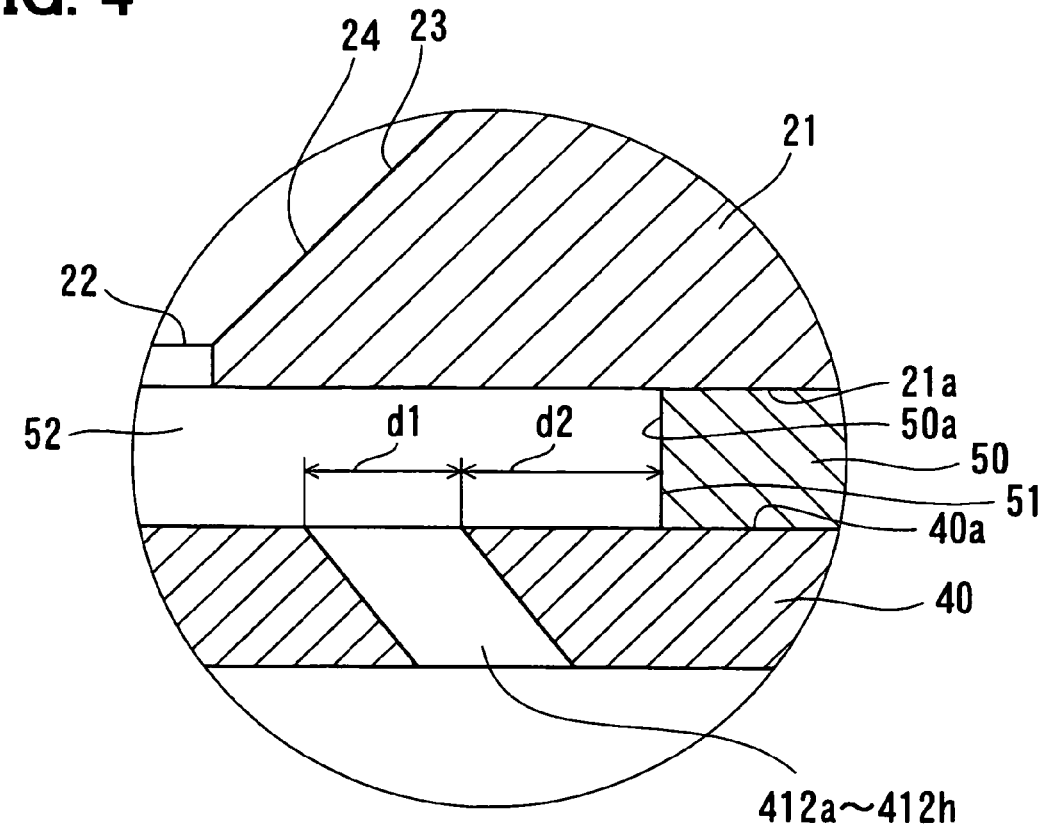
FIG. 4 is a further enlarged cross-sectional view showing a range IV in FIG. 4.
Figure 5:
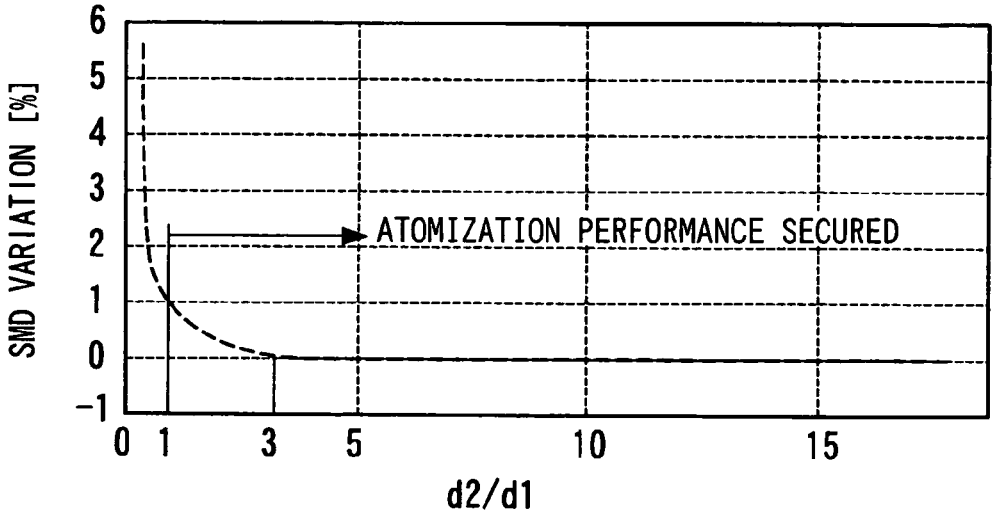
FIG. 5 is a graph schematically showing a SMD (Sauter mean diameter) variation against an arrangement of a fuel injection port.

The inner circumferential surface 50*a* of the spacer 50, which forms the fuel chamber 52, is at a specific distance from fuel inflow side openings of the outer injection ports 412*a*-412*h*. Here, the fuel inflow side openings of the outer injection ports 412*a*-412*h* are ends of them at the side of the fuel chamber 52. As shown in FIG. 4, distances from the fuel inflow side openings of the outer injection ports 412*a*-412*h* and the inner circumferential surface 50*a* of the spacer 50 are set to satisfy a relation of d2/d1≧1, in which d1 denotes inner diameters of the fuel inflow side openings of the outer injection ports 412*a*-42*h*, and d2 denotes distances from the outer injection ports 412*a*-412*h* to the inner circumferential surface 50*a* of the spacer 50. As shown in FIG. 5, as d2/d1 decreases, distances from the fuel inflow side openings of the outer injection ports 412*a*-412*h* to the inner circumferential surface 50*a* of the spacer 50 become smaller. Then, the fuel that is not so highly turbulent in the fuel chamber 52 flows into the outer injection ports 412*a*-412*h*. Accordingly, the atomization performance of the fuel is spoiled, and a Sauter outer diameter (SMD) variation ratio increases. The relation of d2/d1≧1 is a measure against this issue.

The SMD is a value to indicate an average diameter of a fuel injection spray, and the SMD variation ratio, which is shown in FIG. 5, is a value to indicate a variation ratio of the average diameter of the fuel injection spray. An increase of the SMD variation ratio means an increase of the average diameter of the fuel injection spray. In the present embodiment, the SMD variation ratio of 1% or smaller is accepted to secure an atomization performance of the fuel. Accordingly, a minimum threshold of d2/d1 is set to 1, which corresponds to the SMD variation ratio of 1%. When d2/d1 is 3 or larger, the SMD variation ratio is 0.5% or smaller. Accordingly, it is further desirable that d2/d1 is 3 or larger to secure the atomization performance of the fuel further.

The distances between the outer injection ports 412*a*-412*h* and the inner circumferential surface 50*a* of the spacer 50 are set as described above. Thus, as shown in FIG. 1, the inner circumferential surface 50*a* of the spacer 50 may be disposed between the outer injection ports 412*a*-412*h* in the circumferential direction as long as the relation of d2/d1≧1 is satisfied. In the alignment of the injection ports 41 on the injection port plate 40 as shown in FIG. 1, a part of the inner circumferential surface 40*a* of the spacer 40, which forms the fuel chamber 52, juts radially inward at the intervals between the outer injection ports 412*a*-412*h*. In this case, the fuel inflow side openings of the outer injection ports 412*a*-412*h* and the inner circumferential surface 50*a* of the spacer 50 satisfy the relation of d2/d1≧1. The inner circumferential surface 50*a* of the spacer 50 juts from the intervals between the outer injection ports 412*a*-412*h* toward the inner injection ports 411*a*-411*d*.

By the inner circumferential surface 50*a* of the spacer 50 that juts radially inward, an entire volume of the fuel chamber 52 decreases, and a dead volume in the fuel chamber 52 decreases. If the inner circumferential surface 50*a* of the spacer 50 does not juts radially inward, d2/d1 is excessively large at the intervals between the outer injection ports 412*a*-412*h*. As shown in FIG. 5, even when d2/d1 is excessively large, a turbulence degree of the fuel flowing into the outer injection ports 412*a*-412*h*, and the atomization performance of the fuel injected out of the outer injection ports 412*a*-412*h* are not improved so much. Thus, if the inner circumferential surface 50*a* of the spacer 50 does not juts radially inward, the fuel chamber 52 is regarded as including a dead volume at the intervals between the outer injection ports 412*a*-412*h* that does not serve the atomization performance. Correspondingly, in the first embodiment, the inner circumferential surface 50*a* of the spacer 50 that juts radially inward decreases the dead volume not serving the atomization performance. Accordingly, a fuel amount left in the fuel chamber 52 decreases. The fuel chamber 72 is formed only at the periphery of the outer injection ports 732*a*-732*h*, so that a dead volume in the injector 10 decreases, and the fuel sucked into the intake air decreases, so that it is possible to limit an air-fuel ratio variation of the intake air.

An operation of the injector 10 having the above-described construction is described in the following.

When the coil 32 is not energized, the fixed core 13 and movable core 34 generate no electromagnetic attraction force therebetween. Thus, the restitutive force of the spring 17 pushes the movable core 34 and the needle 25 away from the fixed core 13. Accordingly, when the coil 32 is not energized, the seal portion 26 of the needle 25 is seated on the valve seat 24 and no fuel is injected out of the injection ports 41.

When the coil 32 is energized, a magnetic field generated by the coil 32 forms a magnetic circuit in the plate housing 33, the magnetic pipe 12, the movable core 34 and the fixed core 13. Thus, the fixed core 13 and the movable core 34 generate electromagnetic attraction force therebetween. When the electromagnetic attraction force generated between the fixed core 13 and the movable core 34 exceeds the restitutive force of the spring 17, an integrated body of the movable core 34 and the needle 25 moves toward the fixed core 13. Accordingly, the seal portion 26 of the needle 25 lifts off the valve seat 24.

As shown in FIG. 2, the fuel that has entered the injector 10 through the fuel inflow port 15 flows via the fuel filter 16, an inside of the fixed core 13, an inside of the movable core 34, a clearance formed between the movable core 34 and the needle 25, an inside of the magnetic pipe 12 and the fuel port 191 of the stopper 19 into a fuel passage 27. The fuel in the fuel passage 27 further flow via a gap between the valve seat 24 and the seal portion 26, and the fuel chamber 52 into the injection ports 41. Thus, the fuel is injected out of the injection port 52.

When the power supply to the coil 32 is interrupted again, the electromagnetic attraction force between the fixed core 13 and movable core 34 vanishes. Thus, the restitutive force of the spring 17 pushes the integrated body of the movable core 34 and the needle 25 away from the fixed core 13. Accordingly, the seal portion 26 of the needle 25 is seated on the valve seat 24 again to interrupt the fuel flow between the fuel passage 27 and the fuel chamber 52, and the fuel injection stops.

In the first embodiment, the inner circumferential surface 50*a* of the spacer 50 juts radially inward, that is, toward the inner injection ports 411*a*-411*d*, so that a dead volume of the fuel chamber 52 at the periphery of the outer injection ports 412*a*-412*h* decreases. Thus, after the injection of a regulated amount of fuel, the fuel amount left in the fuel chamber 52 is decreased. As a result, the fuel amount sucked into the intake air decreases, and an air-fuel ratio variation of the intake air is limited. Further, by keeping the relation of $d2/d1 \geqq 1$, the spiral flow inertia of the fuel flowing into the outer injection ports 412*a*-412*h* is kept. Accordingly, it is possible to secure a fuel atomization performance and to decrease the dead volume in the combustion chamber 52.

Further, in the first embodiment, the shape of the fuel chamber opening 51 can be changed by replacing the spacer 50 with another one. Thus, fuel atomization property of the fuel injected out of the injection ports 41 can be adjusted by replacing the spacer 50.

Second Embodiment

Figure 6A:
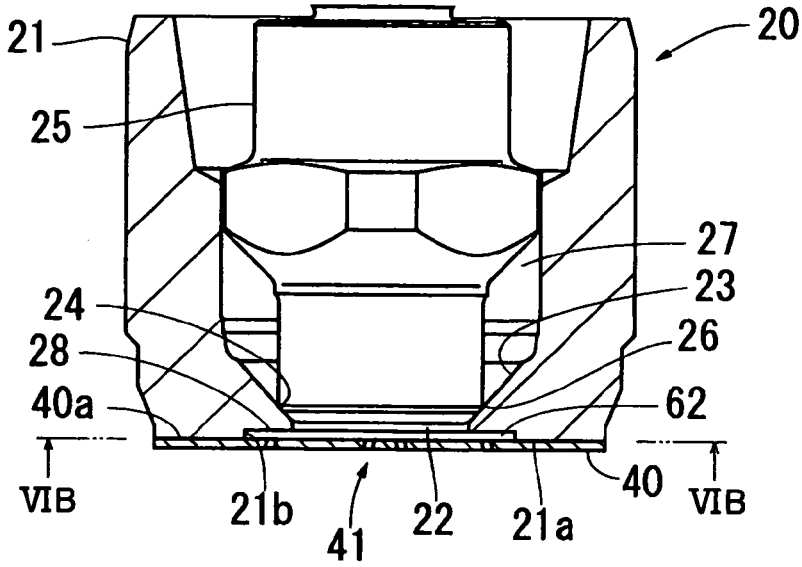
FIG. 6A is an enlarged cross-sectional view showing a fluid injection nozzle in the proximity of the injection port plate according to a second embodiment.
Figure 6B:
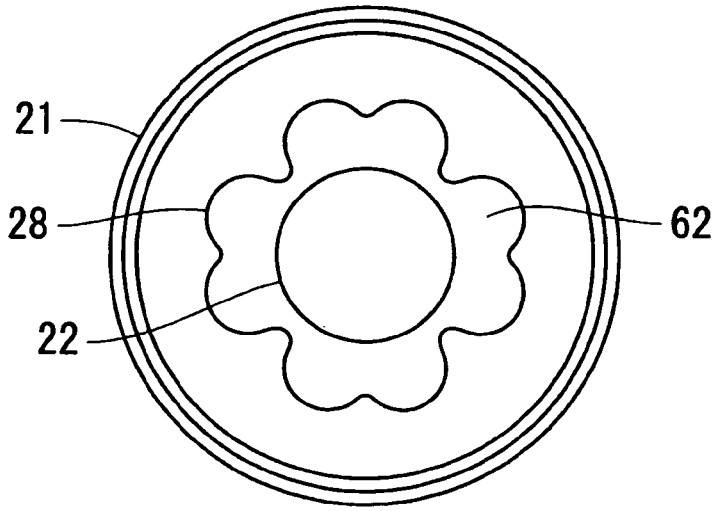
FIG. 6B is a cross-sectional view showing an injection port plate of the fluid injection valve according to the second embodiment, which is taken along a line VIB-VIB in FIG. 6A.

FIGS. 6A and 6B depict a nozzle 20 of the injector 10 according to a second embodiment of the present invention. In the second embodiment, components that are substantially equivalent to those in the first embodiment are assigned reference numerals in common with each other not especially described in the following.

In the first embodiment is disclosed an example in which the spacer 50 having the fuel chamber opening 51 is disposed between the valve body 21 and the injection port plate 40 to provide the fuel chamber 52 between the valve body 21 and the injection port plate 40.

Correspondingly, as shown in FIGS. 6A and 6B, the valve body 21 in the second embodiment is provided with a recess 28 to provide the fuel chamber 62. The recess 28 has a shape equivalent to that of the fuel chamber opening 51 of the spacer 50 in the first embodiment. Thus, the fuel chamber 62 is formed by attaching the injection port plate 40 on the leading end of the valve body 21. As a result, an inner circumferential surface 21*b* of the valve body 21 determines an outer perimeter of the fuel chamber 62. Accordingly, the spacer 50 is not necessary in the second embodiment, and the number of parts of the injector 10 is decreased.

Third Embodiment

Figure 7A:
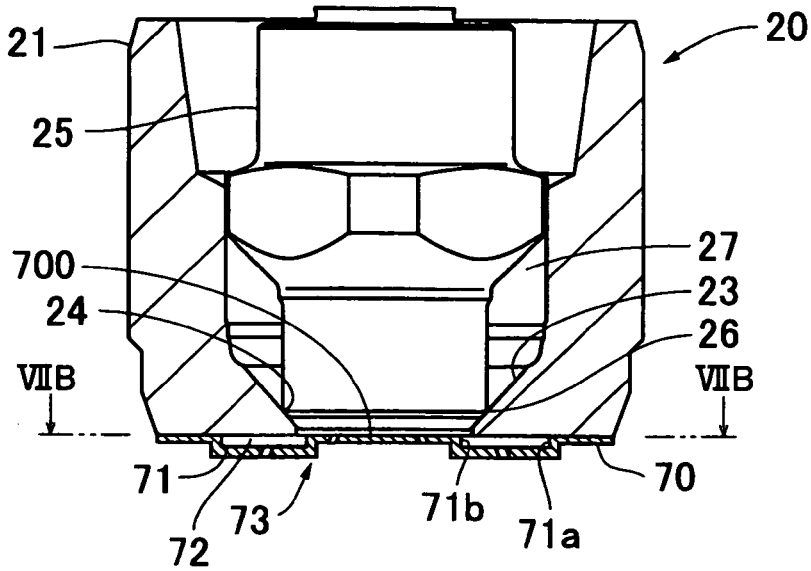
FIG. 7A is an enlarged cross-sectional view showing a fluid injection nozzle in the proximity of the injection port plate according to a third embodiment.
Figure 7B:
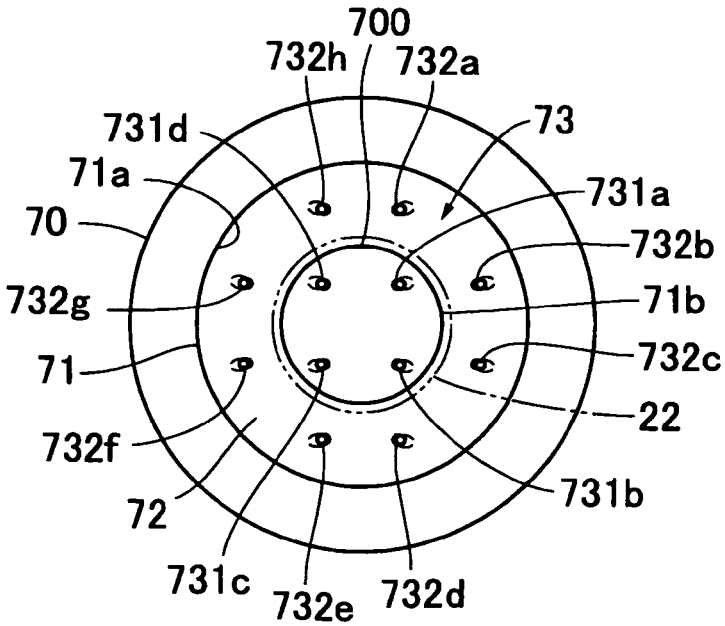
FIG. 7B is a cross-sectional view showing an injection port plate of the fluid injection valve according to the third embodiment, which is taken along a line VIIB-VIIB in FIG. 7A.

FIGS. 7A and 7B depict a nozzle 20 of the injector 10 according to a third embodiment of the present invention. In the third embodiment, components that are substantially equivalent to those in the first embodiment are assigned reference numerals in common with each other not especially described in the following.

In the third embodiment, a recess 71 is formed on the injection port plate 70 in contrast to the second embodiment in which the recess 28 is formed on the valve body 21. The recess 71 of the injection port plate 70 and the valve body 21 provides a fuel chamber 72 therebetween. As shown in FIG. 7B, the injection port plate 70 has a plurality of injection ports 73. Specifically, the injection ports 73 include inner injection ports 731*a*-731*d* and outer injection ports 732*a*-732*h*, which are aligned on two coaxially disposed fictive circle lines. The recess 71 is defined by inner and outer circumferential wall surfaces 71*a*, 71*b*, which are coaxially disposed to the fictive circle lines on which the inner injection ports 731*a*-731*d* and the outer injection ports 732*a*-732*h* are aligned. Thus, the recess 71 is ring-shaped on the injection port plate 70 at the side of the valve body 21.

In the third embodiment, the outer injection ports 732*a*-732*h* are communicated with the fuel chamber 72 at their fuel inflow side openings. A distance from the outer injection ports 732*a*-732*h* to the outer and inner circumferential wall surfaces 71*a*, 71*b* of the recess 71 of the injection port plate 70 satisfies the relation of $d2/d1 \geqq 1$, in which d1 denotes inner diameters of the fuel inflow side openings of the outer injection ports 732*a*-732*h*, and d2 denotes a distance from the fuel inflow side openings of the outer injection ports 732*a*-732*h* to the outer or inner circumferential wall surfaces 71*a*, 71*b*. Thus, the fuel that has passed through the opening portion 22 of the valve body 21 forms a highly turbulent flow, then flows into each of the outer injection ports 732*a*-732*h*.

The spiral fuel flow along a cone-shaped inner circumferential surface 23 of the valve body 21, which has the opening portion 22 at its leading end, directly flows into the inner injection ports 731*a*-731*d*. A distance from the fuel inflow side openings of the inner injection ports 731*a*-731*d* to the inner circumferential wall 23 of the valve body 21, which provides the opening portion 22 is enough to flow highly turbulent fuel into the inner injection ports 731*a*-731*d*.

In the third embodiment, the outer injection ports 732*a*-732*h* and the outer and inner circumferential wall surfaces 71*a*, 71*b* of the recess 71 of the injection port plate 70 satisfies the relation of $d2/d1 \geqq 1$ as described above. Thus, highly turbulent fuel flows into each of the outer injection ports 732*a*-732*h*. Accordingly, an enough fuel atomization performance is secured.

Further, in the third embodiment, fuel inflow side openings of the inner injection ports 731*a*-731*d* open on the surface of the injection port plate 70 directly to the opening portion 22 of the valve body 21. That is, the inner injection ports 731*a*-731*d* are not adjacent to the fuel chamber 72. The fuel chamber 72 is formed only at the periphery of the outer injection ports 732*a*-732*h*, so that a dead volume in the injector 10 decreases, and the fuel left in the fuel chamber 72 also decreases.

Modified Examples of Third Embodiment

Modified examples of the third embodiment are described in the following. In these modified examples, components that are substantially equivalent to those in the third embodiment are assigned reference numerals in common with each other not especially described.

Figure 8A:
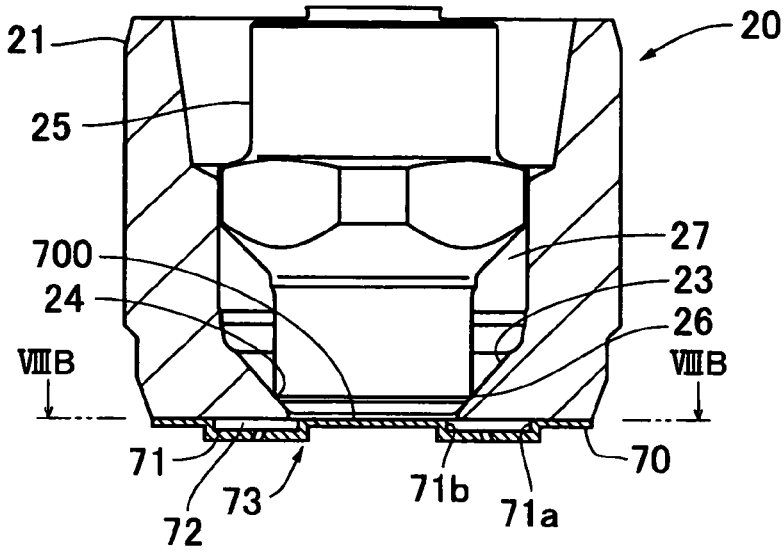
FIG. 8A is an enlarged cross-sectional view showing a fluid injection nozzle in the proximity of the injection port plate according to a first modified example of the third embodiment.
Figure 8B:
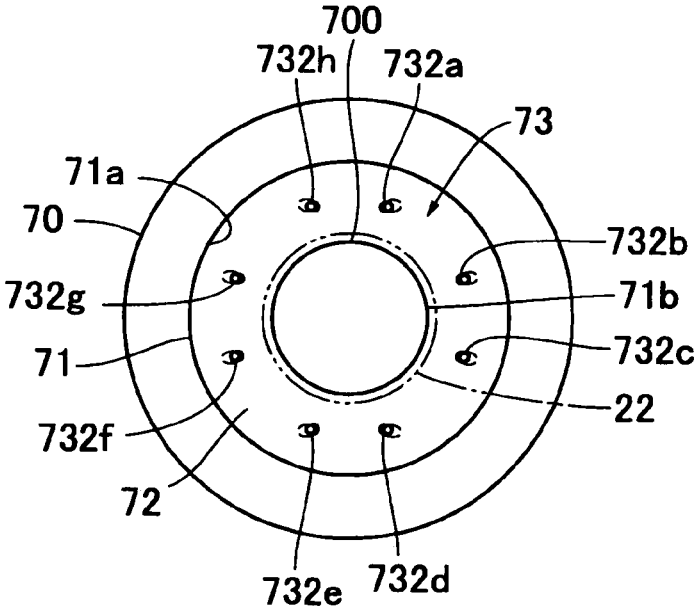
FIG. 8B is a cross-sectional view showing an injection port plate of the fluid injection valve according to the first modified example of the third embodiment, which is taken along a line VIIIB-VIIIB in FIG. 8A.

In a first modified example of the third embodiment shown in FIGS. 8A and 8B, the injection port plate 70 may have no injection port at a projection 700 radially inside of the fuel chamber 72. In this case, the fuel that has passed through the opening portion 22 flows into the fuel chamber 72 formed by the recess 71 radially outside of the projection 700.

Figure 9A:
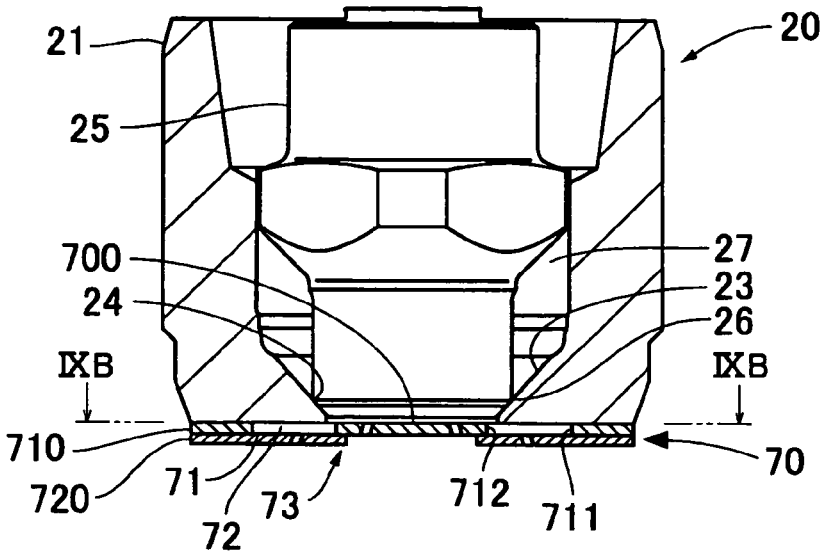
FIG. 9A is an enlarged cross-sectional view showing a fluid injection nozzle in the proximity of the injection port plate according to a second modified example of the third embodiment.
Figure 9B:
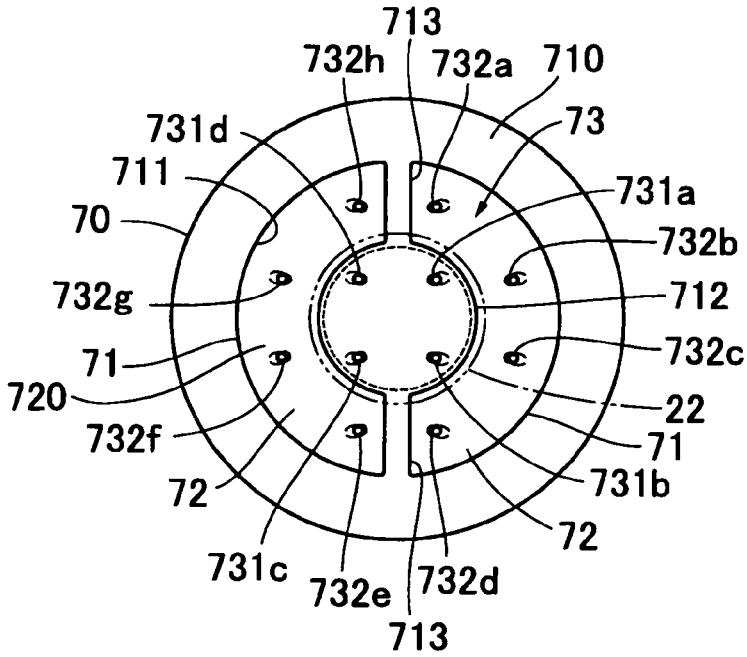
FIG. 9B is a cross-sectional view showing an injection port plate of the fluid injection valve according to the second modified example of the third embodiment, which is taken along a line IXB-IXB in FIG. 9A.

In a second modified example of the third embodiment shown in FIGS. 9A and 9B, the injection port plate 70 is composed of a first injection port plate 710 and a second injection port plate 720. The first injection port plate 710 has a flat ring shape. The first injection port plate 710 is integrally formed with the projection 700, which is disposed at the center of the first injection port plate 710. Specifically, two beams 713 connect the projection 700 at both sides thereof with the injection port plate 710. The second injection port plate 720 also has a flat ring shape, and is fixed on the first injection port plate 720 at a side opposite from the valve body 21. By fixing the second injection port plate 720 on the first injection port plate 710, the projection 700 protrudes from the second injection port plate 720 to face the opening portion 22 of the valve body 21, and the fuel chamber 72 is formed around the projection 700. The outer injection ports 732*a*-732*h* open to the fuel chamber 72. The inner circumferential side surface of the first injection port plate 710 forms an outer circumferential wall surface 711, that is, an outer perimeter of the fuel chamber 72. The outer circumferential side surface of the projection 700 forms an inner circumferential wall surface 712, or an inner perimeter of the fuel chamber 72. On the projection 700 are formed the inner injection ports 731*a*-731*d*.

Figure 10A:
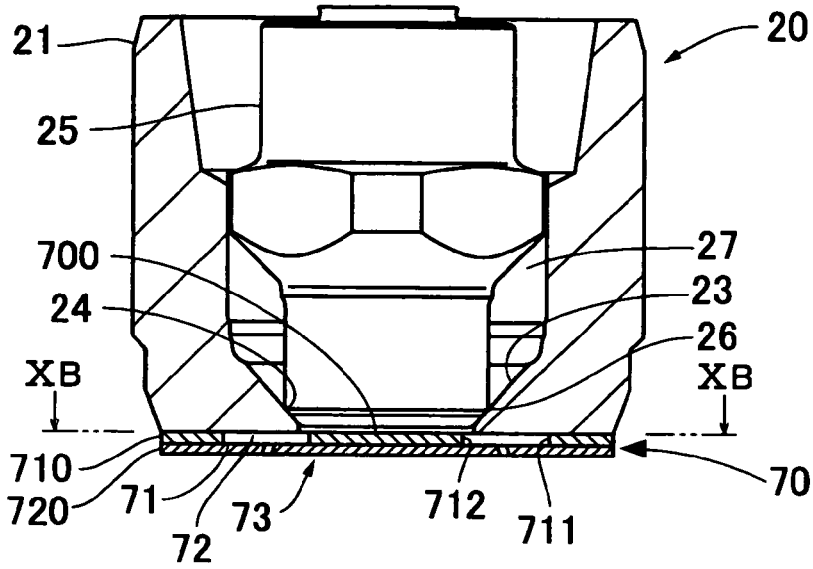
FIG. 10A is an enlarged cross-sectional view showing a fluid injection nozzle in the proximity of the injection port plate according to a third modified example of the third embodiment.
Figure 10B:
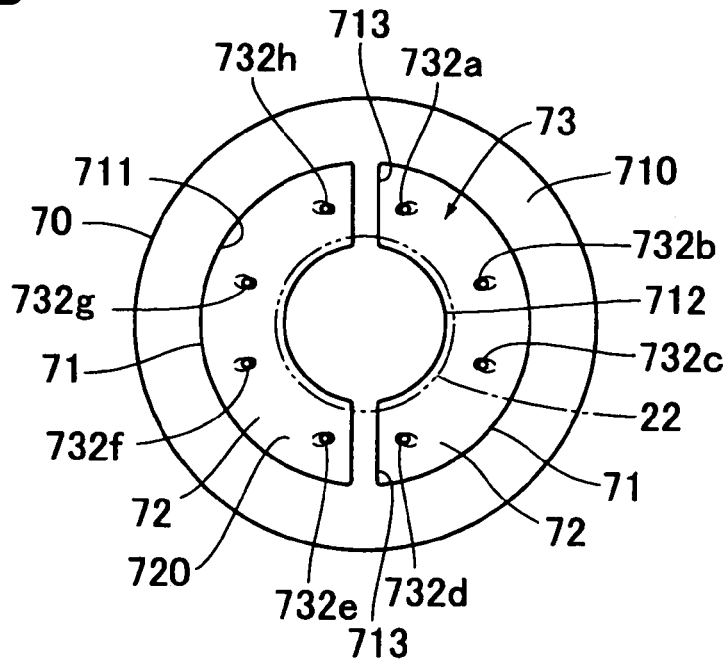
FIG. 10B is a cross-sectional view showing an injection port plate of the fluid injection valve according to the third modified example of the third embodiment, which is taken along a line XB-XB in FIG. 10A.

In a third modified example of the third embodiment shown in FIGS. 10A and 10B, the second injection port plate 720 of the injection port plate 70 has a flat disc shape. The first injection port plate 710 has a construction approximately as that in the second modified example except for being provided with no inner injection port on the projection 700.

Figure 11A:
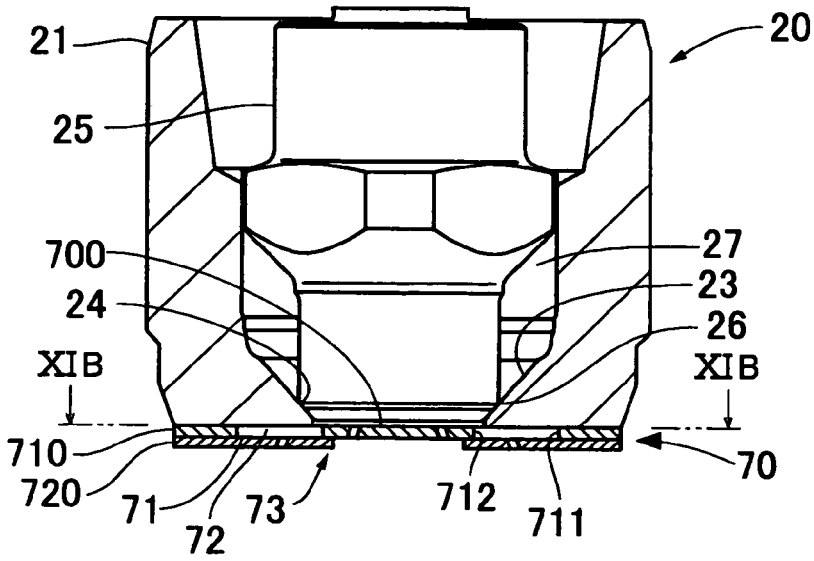
FIG. 11A is an enlarged cross-sectional view showing a fluid injection nozzle in the proximity of the injection port plate according to a fourth modified example of the third embodiment.
Figure 11B:
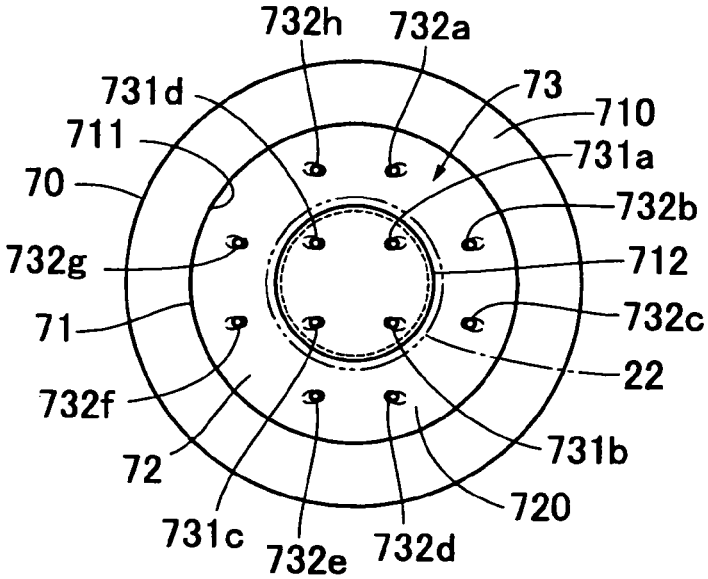
FIG. 11B is a cross-sectional view showing an injection port plate of the fluid injection valve according to the fourth modified example of the third embodiment, which is taken along a line XIB-XIB in FIG. 11A.
Figure 12A:
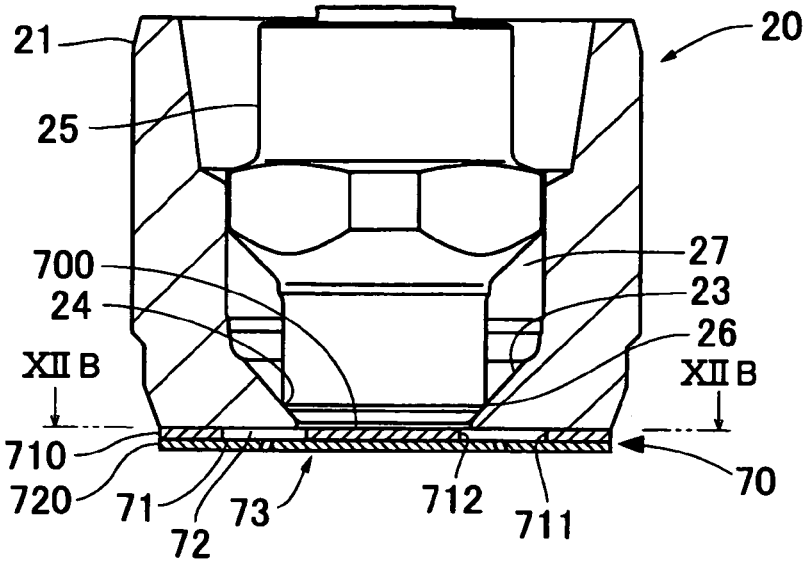
FIG. 12A is an enlarged cross-sectional view showing a fluid injection nozzle in the proximity of the injection port plate according to a fifth modified example of the third embodiment.
Figure 12B:
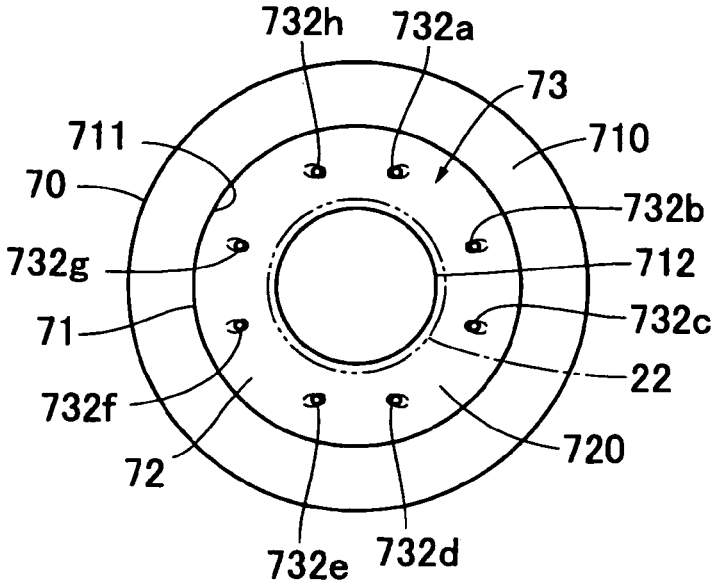
FIG. 12B is a cross-sectional view showing an injection port plate of the fluid injection valve according to the fifth modified example of the third embodiment, which is taken along a line XIIB-XIIB in FIG. 12A.

In a fourth modified example of the third embodiment shown in FIGS. 11A and 11B, the first injection port plate 710 is not provided with the beams 713 in the second modified example. Similarly, in a fifth modified example of the third embodiment shown in FIGS. 12A and 12B, the first injection port plate 710 is not provided with the beams 713 in the third modified example. In the second and third modified examples shown in FIGS. 9A, 9B, 10A and 10B, the projection 700 is integrally formed with the first injection port plate 710, so that it is possible to handle with the first and second injection port plates 710, 720 separately until they are fixed on the valve body 21. Correspondingly, in the fourth and fifth embodiments shown in FIGS. 11A, 11B, 12A and 12B, the projection 700 is separated from the first injection port plate 710, so that the first injection port plate 710 and the projection 700 are fixed on the second injection port plate 720, then they are fixed on the valve body 21.

Fourth Embodiment

Figure 13A:
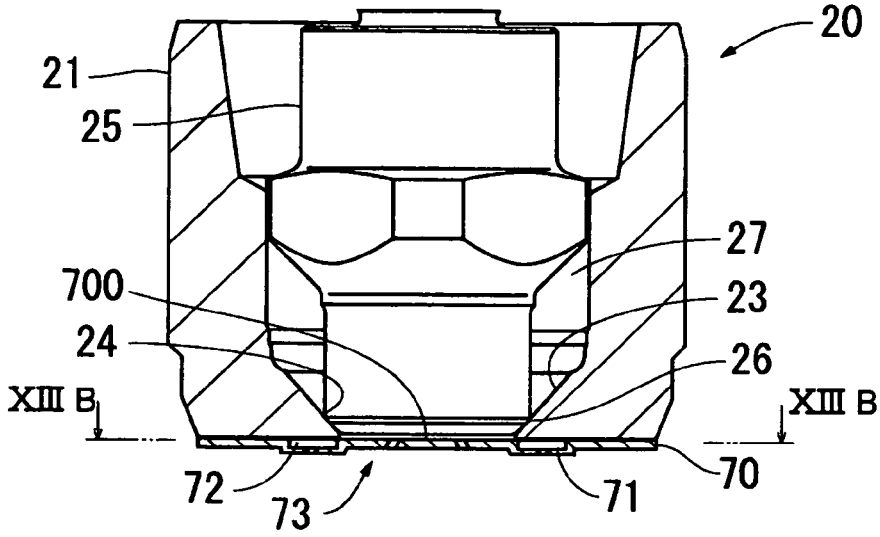
FIG. 13A is an enlarged cross-sectional view showing a fluid injection nozzle in the proximity of the injection port plate according to a fourth embodiment.
Figure 13B:
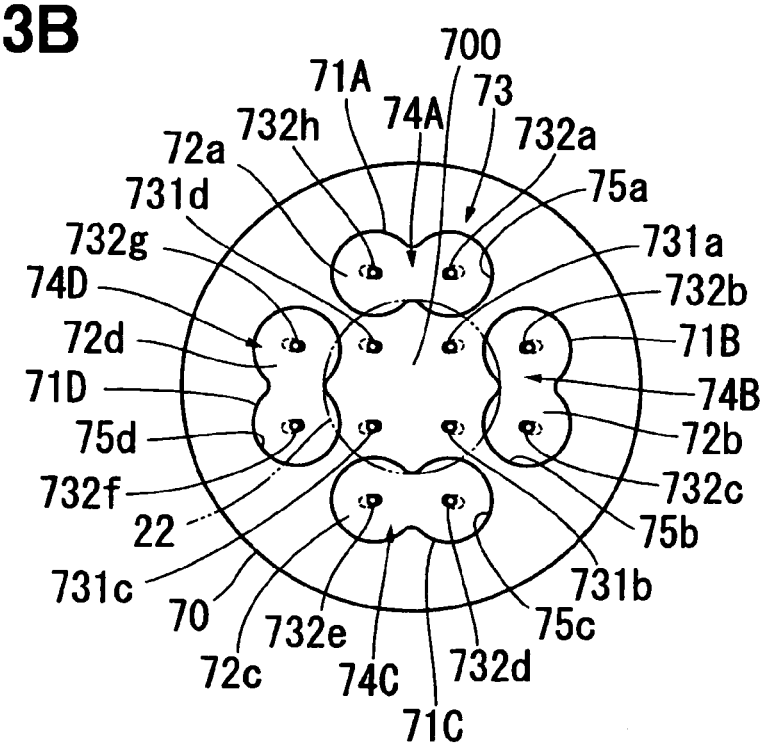
FIG. 13B is a cross-sectional view showing an injection port plate of the fluid injection valve according to the fourth embodiment, which is taken along a line XIIIB-XIIIB in FIG. 13A.

FIGS. 13A and 13B depict a nozzle 20 of the injector 10 according to a third embodiment of the present invention. In the fourth embodiment, components that are substantially equivalent to those in the third embodiment are assigned reference numerals in common with each other not especially described in the following.

In the fourth embodiment, recesses 71 (71*a*-71*d*) are formed on the injection port plate 70 to provide fuel chambers 72 (72*a*-72*d*) in an analogous way to the third embodiment. As shown in FIG. 13B, the injection port plate 70 has inner injection ports 731*a*-731*d* and outer injection ports 732*a*-732*h*, which are aligned on two coaxially disposed fictive circle lines. The fuel inflow side openings of the inner injection ports 731*a*-731*d* open on the surface of the injection port plate 70 directly to the opening portion 22 of the valve body 21 as in the third embodiment.

In the fourth embodiment, the injection port plate 70 has four recesses 71 (71*a*-71*d*). The fuel inflow side openings of the outer injection ports 732*a*-732*h* open to the recesses 71 of the injection port plate 70 to be communicated with the fuel chambers 72. Every two of the eight outer injection ports 732*a*-732*h* constitute one injection port group. Specifically, the outer injection ports 732*a*, 732*h* constitute an injection port group 74A, the outer injection ports 732*b*, 732*c* constitute an injection port group 74B, the outer injection ports 732*d*, 732*e* constitute an injection port group 74C, and the outer injection ports 732*f*, 732*g* constitutes an injection port group 74D. Thus, the eight outer injection ports 732*a*-732*h* constitute four injection port groups 74A-74D.

The injection port plate 70 has four recesses 71*a*-71*d* that respectively correspond to the four injection port groups 74A-74D. That is, the outer injection ports 732*a*, 732*h* open to the recess 71*a*, the outer injection ports 732*b*, 732*c* open to the recess 71*b*, the outer injection ports 732*d*, 732*e* open to the recess 71*c*, and the outer injection ports 732*f*, 732*g* open to the recess 71*d*. Accordingly, four fuel chambers 72*a*-72*d* are formed between the injection port plate 70 and the valve body 21. As a result, the fuel chambers 72*a*-72*d* are provided respectively to the injection port groups 74A-74D that are composed of a plurality of the outer injection ports (732*a*, 732*h*), (732*b*, 732*c*), (732*d*, 732*e*), (732*f*, 732*g*).

Inner circumferential wall surfaces 75*a*-75*d* of the injection port plate 70 define the peripheries of the fuel chambers 72*a*-72*d*. The correspondence between the outer injection ports 732*a*-732*h* and the inner circumferential wall surfaces 75*a*-75*d* are as described above. Distances from the outer injection ports 732*a*-732*h* to the inner circumferential wall surfaces 75*a*-75*d* of the recesses 71*a*-71*d* of the injection port plate 70 satisfies the relation of $d2/d1 \geqq 1$, in which d1 denotes inner diameters of the fuel inflow side openings of the outer injection ports 732*a*-732*h* communicated with the fuel chambers 72*a*-72*d*, and d2 denotes distances from the fuel inflow side openings of the outer injection ports 732*a*-732*h* to the inner circumferential wall surfaces 75*a*-75*d*.

In the fourth embodiment, each of the injection port groups 74A-74D is provided with the fuel chamber 72*a*-72*d*, and no fuel chamber is formed at the intervals between the injection port groups 74A-74D. Thus, a dead volume formed at the intervals between every adjacent two of the injection port groups 74A-74D. Accordingly, it is possible to decrease a fuel amount left in the fuel chambers 72*a*-72*d*.

Modified Examples of Fourth Embodiment

Modified examples of the fourth embodiment are described in the following. In these modified examples, components that are substantially equivalent to those in the fourth embodiment are assigned reference numerals in common with each other not especially described.

Figure 14A:
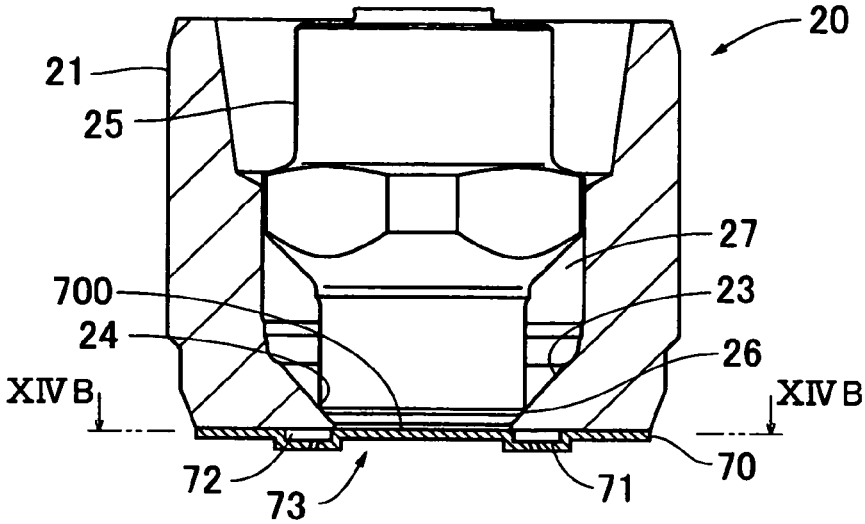
FIG. 14A is an enlarged cross-sectional view showing a fluid injection nozzle in the proximity of the injection port plate according to a first modified example of the fourth embodiment.
Figure 14B:
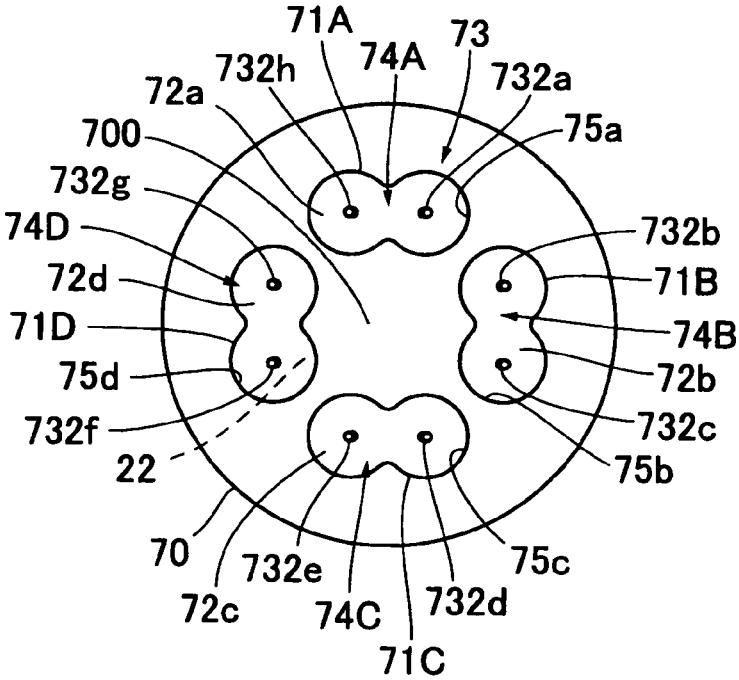
FIG. 14B is a cross-sectional view showing an injection port plate of the fluid injection valve according to the first modified example of the fourth embodiment, which is taken along a line XIVB-XIVB in FIG. 14A.

In a first modified example of the fourth embodiment shown in FIGS. 14A and 14B, the injection port plate 70 may have no injection port at a projection 700 surrounded by the fuel chambers 72 (72*a*-72*d*). In this case, the fuel that has passed through the opening portion 22 flows into the fuel chambers 72 (72*a*-72*d*) formed by the recesses 71 (71A-71D).

Figure 15A:
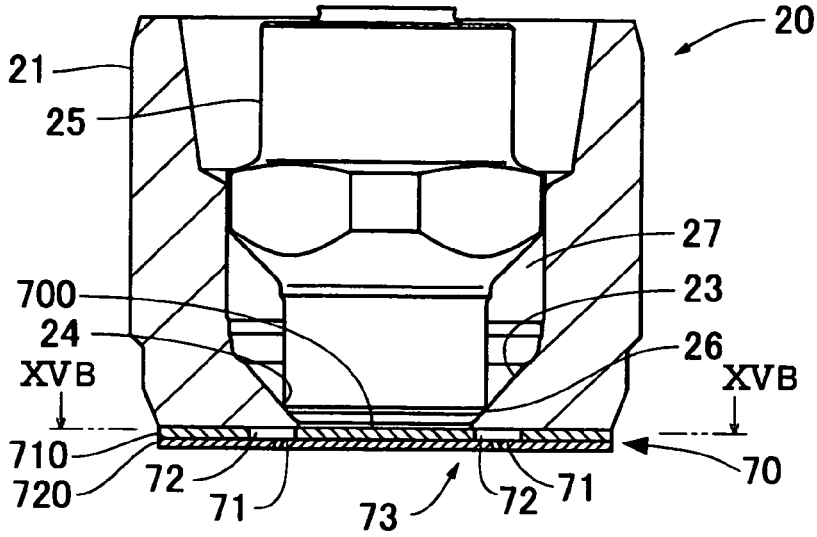
FIG. 15A is an enlarged cross-sectional view showing a fluid injection nozzle in the proximity of the injection port plate according to a first modified example of the fourth embodiment.
Figure 15B:
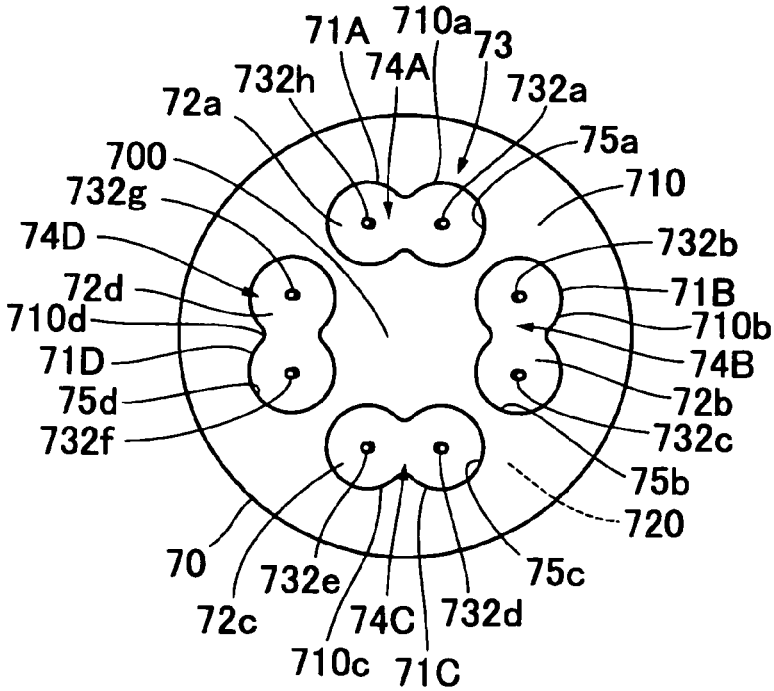
FIG. 15B is a cross-sectional view showing an injection port plate of the fluid injection valve according to the first modified example of the fourth embodiment, which is taken along a line XVB-XVB in FIG. 15A.
Figure 16A:
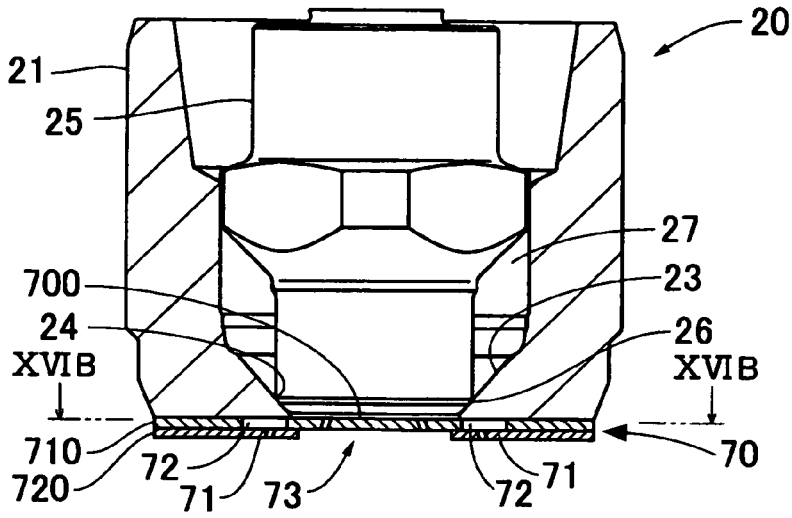
FIG. 16A is an enlarged cross-sectional view showing a fluid injection nozzle in the proximity of the injection port plate according to a first modified example of the fourth embodiment.
Figure 16B:
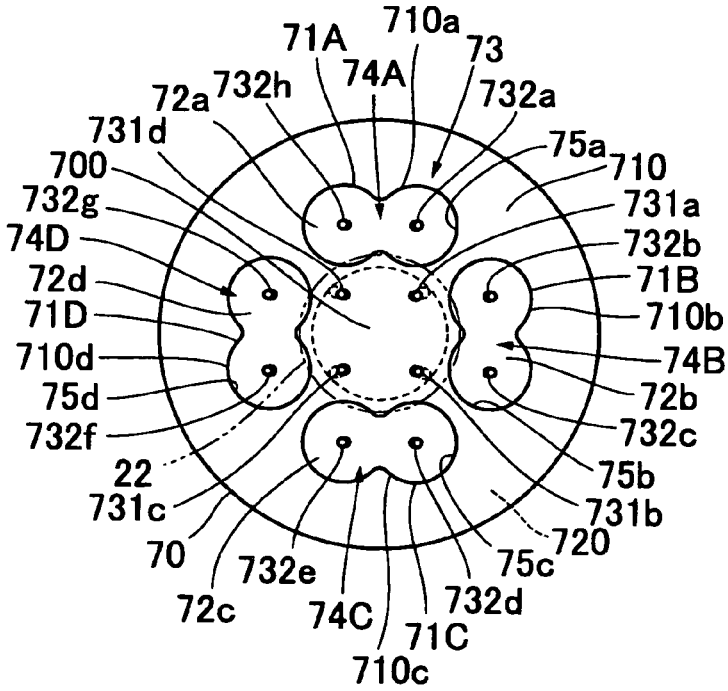
FIG. 16B is a cross-sectional view showing an injection port plate of the fluid injection valve according to the first modified example of the fourth embodiment, which is taken along a line XVIB-XVIB in FIG. 16A.

In a second modified example of the fourth embodiment shown in FIGS. 15A and 15B, the injection port plate 70 is composed of a first injection port plate 710 and a second injection port plate 720. The first injection port plate 710 has four opening portions 710*a*-710*d* respectively in accordance with the fuel chambers 72*a*-72*d*. By fixing the second injection port plate 720 on a surface of the first injection port plate 710 opposite from the valve body 21, the recesses 71 (71A-71D) are formed between the valve body 21, the first injection port plate 70 and the second injection port plate 720. In the second modified embodiment shown in FIGS, the projection 700 is provided with no injection port (the inner injection port). Correspondingly, in the third modified example of the fourth embodiment shown in FIGS. 16A and 16B, the second injection port plate 720 has a flat ring shape, so that the projection 700 of the first injection port plate 710 are formed the injection ports, that is, the inner injection ports 731*a*-731*d*.

Fifth Embodiment

Figure 17A:
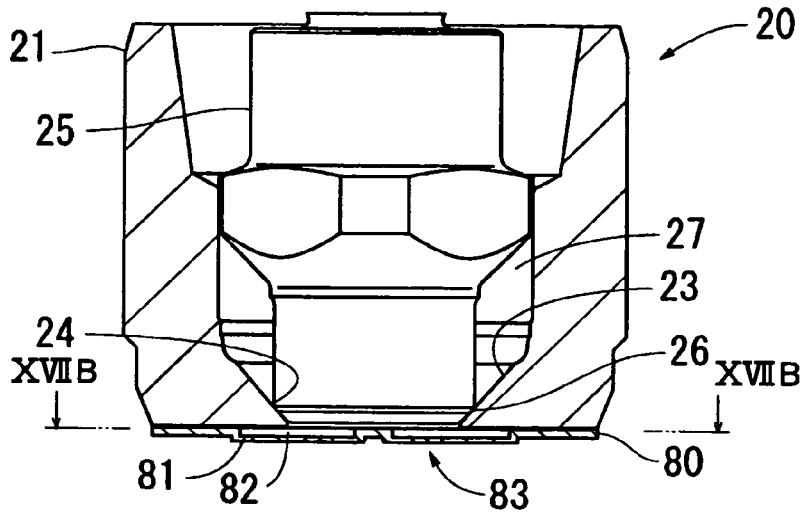
FIG. 17A is an enlarged cross-sectional view showing a fluid injection nozzle in the proximity of the injection port plate according to a fifth embodiment.
Figure 17B:
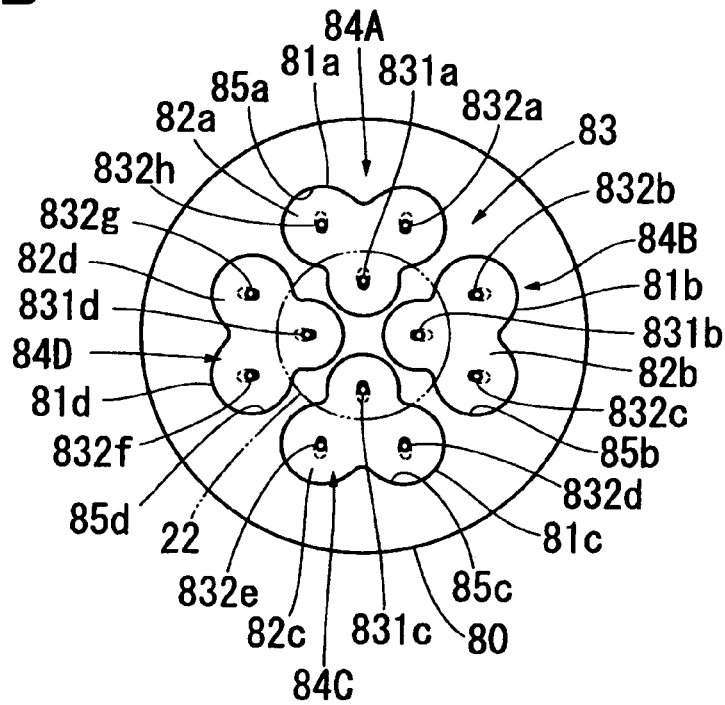
FIG. 17B is a cross-sectional view showing an injection port plate of the fluid injection valve according to the fifth embodiment, which is taken along a line XVII-XVII in FIG. 17A.

FIGS. 17A and 17B depict a nozzle 20 of the injector 10 according to a fifth embodiment of the present invention. In the fifth embodiment, components that are substantially equivalent to those in the first embodiment are assigned reference numerals in common with each other not especially described in the following.

In the fifth embodiment, recesses 81 (81*a*-81*d*) are formed on the injection port plate 80 to provide fuel chambers 82 (82*a*-82*d*) in an analogous way to the third embodiment. The injection port plate 70 has a plurality of injection ports 83. Specifically, the injection ports 893 include inner injection ports 831*a*-831*d* and outer injection ports 832*a*-832*h*, which are aligned on two coaxially disposed fictive circle lines as shown in FIG. 17B.

In the fifth embodiment, the injection port plate 80 has four recesses 81 (81*a*-81*d*). Three injection ports including one of the four inner injection ports 831*a*-831*d* and two of the eight outer injection ports 832*a*-832*h* constitute one injection port group. Specifically, the inner injection port 831*a* and the outer injection ports 832*a*, 832*h* constitute an injection port group 84A, the inner injection port 831*b* and the outer injection ports 832*b*, 832*c* constitute an injection port group 84B, the inner injection port 831*c* and the outer injection ports 832*d*, 832*e* constitute an injection port group 84C, and the inner injection port 831*d* and the outer injection ports 832*f*, 832*g* constitute an injection port group 84D. Thus, the four inner injection ports 831*a*-831*d* and the eight outer injection ports 832*a*-832*h* constitute four injection port groups 84A-84D.

The injection port plate 80 has four recesses 81*a*-81*d* that respectively correspond to the four injection port groups 84A-84D. That is, the inner injection port 831*a* and the outer injection ports 832*a*, 832*h* open to the recess 81*a*, the inner injection port 831*b* and the outer injection ports 832*b*, 832*c* open to the recess 81*b*, the inner injection port 831*c* and the outer injection ports 832*d*, 832*e* open to the recess 81*c*, and the inner injection port 831*d* and the outer injection ports 832*f*, 832*g* open to the recess 81*d*. Accordingly, four fuel chambers 82*a*-82*d* are formed between the injection port plate 80 and the valve body 21. As a result, the fuel chambers 82*a*-82*d* are provided respectively to the injection port groups 84A-84D that are composed of a plurality of the inner and outer injection ports (831*a*, 832*a*, 832*h*), (831*b*, 832*b*, 832*c*), (831*c*, 832*d*, 832*e*), (831*d*, 832*f*, 832*g*).

The correspondence between the inner and outer injection ports 831*a*-831*d*, 832*a*-832*h* and the inner circumferential wall surfaces 85*a*-85*d*, which define the peripheries of the fuel chambers 82*a*-82*d*, are as described above. Distances from the inner and outer injection ports 831*a*-831*d*, 832*a*-832*h* to the inner circumferential wall surfaces 85*a*-85*d* of the recesses 81*a*-81*d* of the injection port plate 80 satisfies the relation of d2/d1≧1, in which d1 denotes inner diameters of the fuel inflow side openings of the inner and outer injection ports 831*a*-831*d*, 832*a*-832*h* communicated with the fuel chambers 82*a*-82*d*, and d2 denotes distances from the fuel inflow side openings of the inner and outer injection ports 831*a*-831*d*, 832*a*-832*h* to the inner circumferential wall surfaces 85*a*-85*d*.

In the fifth embodiment, each of the injection port groups 84A-84D is provided with the fuel chamber 82*a*-82*d*, and no fuel chamber is formed at the intervals between the injection port groups 84A-84D, which include not only the outer injection ports 832*a*-832*h* but also the inner injection ports 831*a*-831*d*. Thus, a dead volume formed at the intervals between every adjacent two of the injection port groups 84A-84D. Accordingly, it is possible to decrease a fuel amount left in the fuel chambers 82*a*-82*d*.

Sixth Embodiment

Figure 18A:
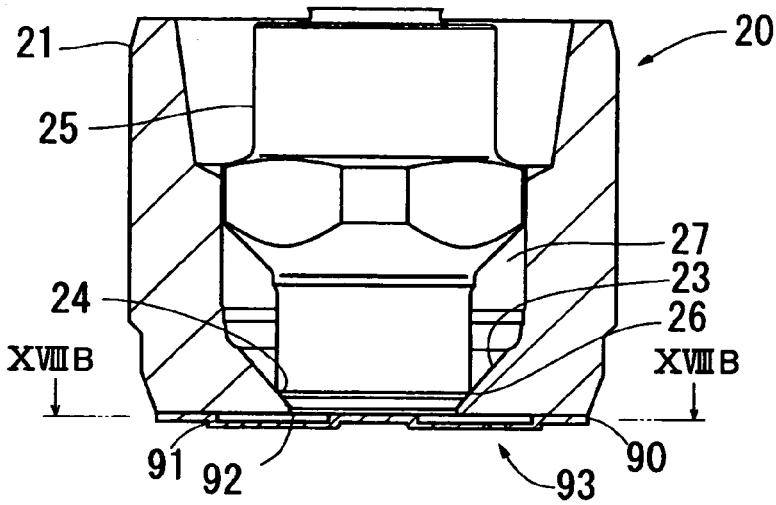
FIG. 18A is an enlarged cross-sectional view showing a fluid injection nozzle in the proximity of the injection port plate according to a sixth embodiment.
Figure 18B:
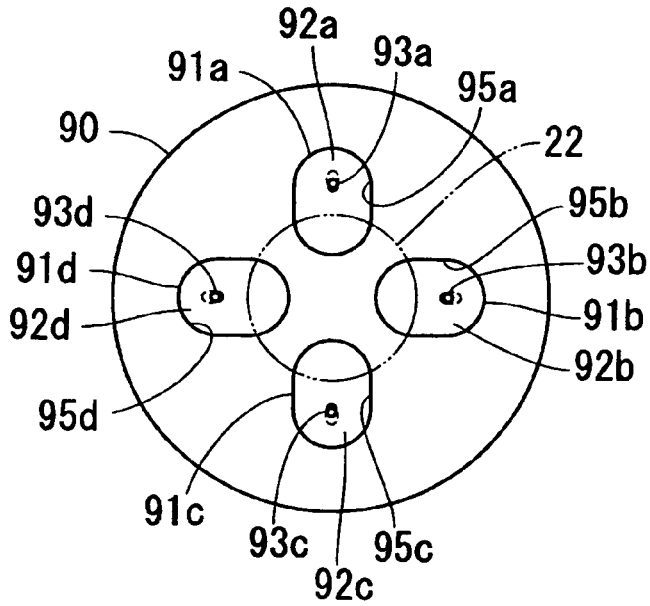
FIG. 18B is a cross-sectional view showing an injection port plate of the fluid injection valve according to the sixth embodiment, which is taken along a line XVIII-XVIII in FIG. 18A.

FIGS. 18A and 18B depict a nozzle 20 of the injector 10 according to a sixth embodiment of the present invention. In the sixth embodiment, components that are substantially equivalent to those in the first embodiment are assigned reference numerals in common with each other not especially described in the following.

In the sixth embodiment, recesses 91 (91*a*-91*d*) are formed on the injection port plate 90 to provide fuel chambers 92 (92*a*-92*d*) in an analogous way to the third embodiment. As shown in FIG. 18B, the injection port plate 90 has injection ports 93*a*-93*d*, which are aligned on a fictive circle line.

In the sixth embodiment, the injection port plate 90 has four recesses 91*a*-91*d* that respectively correspond to the four injection ports 93*a*-93*d*. That is, the injection port 93*a* opens to the recess 91*a*, the injection port 93*b* opens to the recess 91*b*, the injection port 93*c* opens to the recess 91*c*, and the injection port 93*d* opens to the recess 91*d*. Accordingly, four fuel chambers 92*a*-92*d* are formed between the injection port plate 90 and the valve body 21. As a result, the fuel chambers 92*a*-92*d* are provided respectively to the injection ports 93*a*-93*d*. The correspondence between the injection ports 93*a*-93*d* and the inner circumferential wall surfaces 95*a*-95*d*, which define the peripheries of the fuel chambers 92*a*-92*d*, are as described above. Distances from the injection ports 93*a*-93*d* to the inner circumferential wall surfaces 95*a*-95*d* of the recesses 91*a*-91*d* of the injection port plate 90 satisfies the relation of d2/d1≧1, in which d1 denotes inner diameters of the fuel inflow side openings of the injection ports 93*a*-93*d* communicated with the fuel chambers 92*a*-92*d*, and d2 denotes distances from the fuel inflow side openings of the injection ports 93*a*-93*d* to the inner circumferential wall surfaces 95*a*-95*d*.

In the sixth embodiment, each of the injection ports 93*a*-93*d* is provided with the fuel chamber 92*a*-92*d*, and no fuel chamber is formed at the intervals between the injection ports 93*a*-93*d*. Thus, a dead volume formed at the intervals between every adjacent two injection ports 93*a*-93*d*. Thus, a dead volume formed at the intervals between every adjacent two injection ports 93*a*-93*d*. Accordingly, it is possible to decrease a fuel amount left in the fuel chambers 92*a*-92*d*.

Other Embodiments

Figure 19:
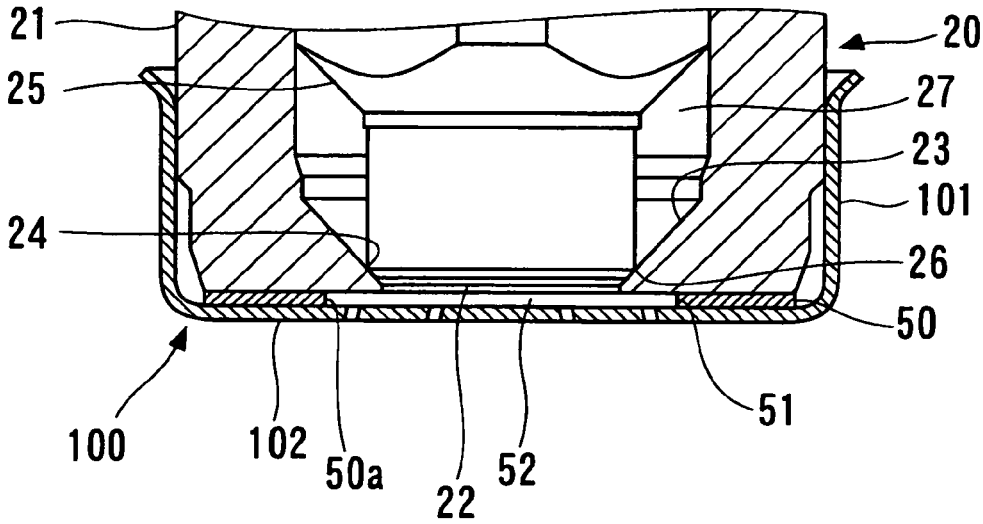
FIG. 19 is an enlarged cross-sectional view showing a fluid injection nozzle in the proximity of the injection port plate according to another embodiment.

In the above-described embodiments are described constructions in which any one of flat plate-shaped spacer 50 and an injection port plate 40, 70, 80, 90 is attached on the leading end of the valve body 21. Alternatively, as shown in FIG. 19, the injector may have a construction in which the leading end of the valve body 21 is capped with an approximately cup-shaped injection port plate 100 that has a cylindrical portion 101 and bottom portion 102 on which injection ports 41 are formed.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fluid injection valve comprising:

a valve body that is provided with an opening portion at one axial end thereof to discharge a fluid out of the opening portion; and an injection port plate having a plurality of injection ports that penetrate therethrough, the injection port plate being fixed at the one axial end of the valve body; wherein a spacer wall portion is disposed between a portion of the valve body surrounding the opening portion and the injection hole plate, the spacer wall portion having an inner circumferential surface radially outward of the opening portion and disposed to surround the plurality of injection ports, so that a fluid chamber is defined by the inner circumferential surface, an axial surface of the valve body facing the injection port plate, and an axial surface of the injection port plate, the fluid chamber having a diameter larger than the opening portion, said inner circumferential surface of said spacer wall portion being disposed at a predetermined distance from said injection ports, wherein the inner circumferential surface of the spacer plate juts radially inward into intervals between at least some of the injection ports.

2. The fluid injection valve according to claim 1, wherein the predetermined distance is equal to or greater than an inner diameter of an opening of the injection port on the valve body side of said injection port plate.

3. The fluid injection valve according to claim 2, wherein the predetermined distance is three times said inner diameter of the injection port.

4. The fluid injection valve according to claim 1, wherein:

the injection ports are aligned in a circumferential direction of the injection port plate; and the circumferential surface juts radially inward into the intervals between the injection ports.

5. The fluid injection valve according to claim 1, wherein:

the injection ports includes inner injection ports aligned on an inner fictive circle line and outer injection ports aligned on an outer fictive circle line that is coaxial to the inner fictive circle line; and the circumferential surface surrounds the outer injection ports so as to jut into the intervals between the outer injection ports.

6. The fluid injection valve according to claim 1, wherein:

the fluid chamber includes a plurality of small fluid chambers; and more than two of the fuel injection ports open to each of the small fluid chambers.

7. The fluid injection valve according to claim 1, wherein:

the fluid chamber includes a plurality of small fluid chambers; and one of the fuel injection ports open to each of the small fluid chambers.

8. The fluid injection valve according to claim 1, wherein the valve body is provided with a recess on the axial end thereof; and the fluid chamber is defined by the recess and the injection port plate.

9. The fluid injection valve according to claim 1, wherein:

the injection port plate is provided with a recess on the surface thereof; and the fluid chamber is defined by the recess and the valve body.

10. The fluid injection valve according to claim 9, wherein the recess is formed around a radially central portion of the injection port plate.

11. The fluid injection valve according to claim 9, wherein the injection port plate includes a first injection port plate and a second injection port plate that are fixed on each other.

12. The fluid injection valve according to claim 1, wherein the injection ports include inner injection ports aligned on an inner fictive circle line and outer injection ports aligned on an outer fictive circle line that is coaxial to the inner fictive circle line; and the inner circumferential surface of the spacer wall portion surrounds the outer injection ports so as to jut into at least some intervals between the outer injection ports.

13. The fluid injection valve according to claim 1, wherein the injection ports include inner injection ports aligned on an inner fictive circle line and an outer injection ports aligned on an outer fictive circle line that is coaxial to the inner fictive circle line; and the inner circumferential surface of the spacer wall portion comprises a plurality of arcs extending part circumferentially of each of said outer injection ports at a radius from said outer injection ports corresponding to said predetermined distance.

14. The fluid injection valve according to claim 1, wherein at least some of said injection ports are disposed radially outside said opening portion.

15. The fluid injection valve according to claim 1, wherein said spacer wall portion comprises a spacer plate disposed between said valve body and said injection hole plate.

* * * * *